US009799194B2

(12) United States Patent
Wang et al.

(10) Patent No.: US 9,799,194 B2
(45) Date of Patent: Oct. 24, 2017

(54) METHOD FOR DETECTING DROWNING AND DEVICE FOR DETECTING DROWNING

(71) Applicant: BOE Technology Group Co., Ltd., Beijing (CN)

(72) Inventors: Tao Wang, Beijing (CN); Yuanzheng Guo, Beijing (CN); Xiaobo Du, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/110,315

(22) PCT Filed: Sep. 11, 2015

(86) PCT No.: PCT/CN2015/089438

§ 371 (c)(1),
(2) Date: Jul. 7, 2016

(87) PCT Pub. No.: WO2016/192235

PCT Pub. Date: Dec. 8, 2016

(65) Prior Publication Data

US 2017/0148298 A1 May 25, 2017

(30) Foreign Application Priority Data

Jun. 3, 2015 (CN) ..... 2015 1 0300941

(51) Int. Cl.
*G08B 23/00* (2006.01)
*G08B 21/08* (2006.01)
*G08B 21/04* (2006.01)

(52) U.S. Cl.
CPC ..... *G08B 21/088* (2013.01); *G08B 21/0446* (2013.01)

(58) Field of Classification Search
CPC ..... G08B 21/088; H04W 4/02
(Continued)

(56) References Cited

U.S. PATENT DOCUMENTS 5,907,281 A * 5/1999 Miller, Jr. ..... G08B 21/088 340/539.1
8,022,830 B1 9/2011 Yang
(Continued)

FOREIGN PATENT DOCUMENTS

AU 2011211464 A1 6/2012
CN 102324167 A 1/2012
(Continued)

OTHER PUBLICATIONS

First Office Action, including Search Report, for Chinese Patent Application No. 201510300941.1, dated Oct. 26, 2016, 15 pages.
International Search Report and Written Opinion for International Application No. PCT/CN2015/089438, dated Feb. 16, 2016, 10 pages.
English translation of Box No. V of the Written Opinion from the International Searching Authority for International Application No. PCT/CN2015/089438, 2 pages.

*Primary Examiner* — Fabricio R Murillo Garcia
(74) *Attorney, Agent, or Firm* — Westman, Champlin & Koehler, P.A.

(57) ABSTRACT

A method for detecting drowning is disclosed. The method includes steps of: collecting a plurality of detection signals; recording the plurality of detection signals and determining whether a drowning is happening or not by calculating and analyzing each of the detection signals; and sending out a drowning signal K when it is determined from all of the detection signals that the drowning is happening. A device for detecting drowning is further disclosed. An intelligent and quick detection for drowning situation is achieved, and an accuracy of drowning detection is improved, since the plurality of detection signals sent by a plurality of sensors worn by a drowner are detected.

4 Claims, 2 Drawing Sheets

(58) Field of Classification Search
USPC ..... 340/573.6
See application file for complete search history.

(56) References Cited

U.S. PATENT DOCUMENTS

| | | | | |
|---|---|---|---|---|
| 8,517,603 | B2 | 8/2013 | Fraden | |
| 9,251,686 | B1 * | 2/2016 | Reich | G08B 21/088 |
| 2008/0061992 | A1 | 3/2008 | Humbard | |
| 2010/0030482 | A1 * | 2/2010 | Li | A61B 5/1112 702/19 |
| 2012/0062377 | A1 * | 3/2012 | Mock | G08B 21/088 340/539.11 |
| 2015/0116116 | A1 * | 4/2015 | Yang | G08B 21/088 340/573.6 |

FOREIGN PATENT DOCUMENTS

| | | | |
|---|---|---|---|
| CN | 102667429 | A | 9/2012 |
| CN | 103236136 | A | 8/2013 |
| CN | 103295366 | A | 9/2013 |
| CN | 203338531 | U | 12/2013 |
| CN | 104433009 | A | 3/2015 |
| CN | 104537273 | A | 4/2015 |
| CN | 104881959 | A | 9/2015 |
| CN | 204808551 | U | 11/2015 |

* cited by examiner

METHOD FOR DETECTING DROWNING AND DEVICE FOR DETECTING DROWNING

CROSS-REFERENCE TO RELATED APPLICATION

This application is a Section 371 National Stage Application of International Application No. PCT/CN2015/089438, filed on Sep. 11, 2015, entitled "METHOD FOR DETECTING DROWNING AND DEVICE FOR DETECTING DROWNING", which claims priority to Chinese Application No. 201510300941.1, filed on Jun. 3, 2015, incorporated herein by reference in their entirety.

BACKGROUND OF THE INVENTION

Field of the Invention

Embodiments of the present disclosure relate to a technical field of intelligent detection, and more particularly, to a method for detecting drowning and a device for detecting drowning.

Description of the Related Art

At present, conventional smart wearable devices mainly focus on a function of day-to-day health condition detection, such as sleep monitoring, heart rate monitoring, respiration monitoring, pedo-metering or the like.

However, such detection functions are relatively simple, and there is not achieved an intelligent, precise, quick detection method and device for some special environments, especially a relatively dangerous environment, for example, an environment where a drowning is happening.

SUMMARY OF THE INVENTION

The present disclosure aims to solve the problem in the prior art that it cannot quickly and precisely send out a distress signal in the case that a dangerous situation of drowning occurs.

To solve the above technical problem, the present disclosure provides technical solutions of a method for detecting drowning and a device for detecting drowning.

There is provided a method for detecting drowning, comprising steps of:

S1: collecting a plurality of detection signals;

S2: recording the plurality of detection signals and determining whether a drowning is happening or not by calculating and analyzing each of the detection signals; and S3: sending out a drowning signal K when it is determined from all of the detection signals that the drowning is happening.

Optionally, the step of determining whether a drowning is happening or not by calculating and analyzing each of the detection signals comprises: comparing a result obtained by calculating and analyzing a currently collected detection signal with a result obtained by calculating and analyzing a previously collected detection signal.

Optionally, the plurality of detection signals comprise a temperature signal, a pressure signal and an acceleration signal.

Optionally, a step of processing the temperature signal comprises:

recording a temperature signal $T_i$ at time $t_i$;

comparing the temperature signal $T_i$ with a temperature signal $T_{i-1}$ at time $t_{i-1}$ and obtaining a temperature difference $\Delta T_i=|T_i-T_{i-1}|$;

determining that the drowning is happening and sending out a drowning signal K1 in a case of $\Delta T_i \geq \Delta T_0$, $\Delta T_{i+n}=0$ and $t_{i+n}-t_i \geq t_T$, where $\Delta T_0$ is a preset temperature difference value, $t_T$ is a preset time value, and i and n are positive integers.

Optionally, a step of processing the pressure signal comprises:

recording a pressure signal $P_i$ at time $t_i$;

comparing the pressure signal $P_i$ with a pressure signal $P_{i-1}$ at time $t_{i-1}$ and obtaining a pressure difference $\Delta P_i=|P_i-P_{i-1}|$;

determining that the drowning is happening and sending out a drowning signal K2 in a case of $\Delta P_i>0$, $P_{i+n}>0$, $\Delta P_{i+n}=0$ and $t_{i+n}-t_i \geq t_P$, where $t_P$ is a preset time value, and i and n are positive integers.

Optionally, a step of processing the acceleration signal comprises:

recording an acceleration signal;

calculating a frequency f at which motion directions change, and comparing the frequency f with a preset frequency value $f_0$, and determining that the drowning is happening and sending out a drowning signal K3 in a case of $f \geq f_0$.

In another aspect, there is provided a device for detecting drowning, comprising:

a signal detecting unit configured to collect a plurality of detection signals;

a control unit configured to record the plurality of detection signals and determine whether a drowning is happening or not by calculating and analyzing the plurality of detection signals; and a signal sending unit configured to send out a drowning signal.

Optionally, the signal detecting unit comprises a temperature signal detecting subunit, a pressure signal detecting subunit and an acceleration signal detecting subunit.

Optionally, the control unit comprises: a signal recording subunit configured to record the plurality of detection signals; and a calculating and analyzing subunit configured to determine whether a drowning is happening or not by calculating and analyzing the plurality of detection signals.

Optionally, the signal recording subunit is configured to record a temperature signal $T_i$ sent by the temperature signal detecting subunit at time $t_i$;

the calculating and analyzing subunit is configured to compare the temperature signal $T_i$ with a temperature signal $T_{i-1}$ at time $t_{i-1}$ and obtain a temperature difference $\Delta T_i=|T_i-T_{i-1}|$; and the calculating and analyzing subunit determines that the drowning is happening and the signal sending unit sends out a drowning signal K1 in a case of $\Delta T_i \geq \Delta T_0$, $\Delta T_{i+n}=0$ and $t_{i+n}-t_i \geq t_T$, where $\Delta T_0$ is a preset temperature difference value, $t_T$ is a preset time value, and i and n are positive integers.

Optionally, the signal recording subunit is configured to record a pressure signal $P_i$ sent by the pressure signal detecting subunit at time $t_i$;

the calculating and analyzing subunit is configured to compare the pressure signal $P_i$ with a pressure signal $P_{i-1}$ at time $t_{i-1}$ and obtain a pressure difference $\Delta P_i=|P_i-P_{i-1}|$; and the calculating and analyzing subunit determines that the drowning is happening and the signal sending unit sends out a drowning signal K2 in a case of $\Delta P_i>0$, $P_{i+n}>0$, $\Delta P_{i+n}=0$ and $t_{i+n}-t_i \geq t_P$, where $t_P$ is a preset time value, and i and n are positive integers.

Optionally, the signal recording subunit is configured to record an acceleration signal sent by the acceleration signal detecting subunit;

the calculating and analyzing subunit is configured to calculate a frequency f at which motion directions change; and the calculating and analyzing subunit determines that the drowning is happening and the signal sending unit sends out a drowning signal K3 in a case of $f \geq f_0$, where $f_0$ is a preset frequency value.

According to the method for detecting drowning and the device for detecting drowning provided in the present disclosure, an intelligent and quick detection for drowning situation is achieved, and an accuracy of drowning detection is improved, since the plurality of detection signals sent by a plurality of sensors worn by a drowner are detected.

In the Figures,

1—signal detecting unit; 11—temperature signal detecting subunit; 12—pressure signal detecting subunit; 13—acceleration signal detecting subunit; 2—control unit; 21—signal recording subunit; 22—calculating and analyzing subunit; 3—signal sending unit.

DETAILED DESCRIPTION OF PREFERRED EMBODIMENTS OF THE INVENTION

In order to enable the person skilled in the art to more comprehensively understand technical solutions of the present disclosure, the present disclosure will be further described in detail with reference to embodiments in combination with accompanying figures.

Embodiment I

Figure 1:
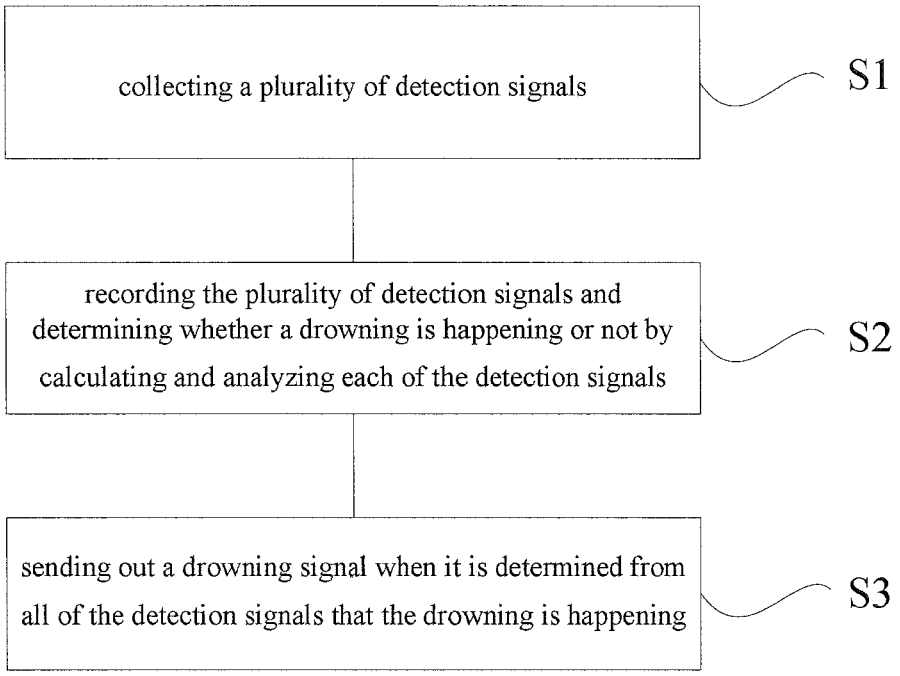
FIG. 1 is a flow chart showing steps of a method for detecting drowning according to an embodiment of the present disclosure.

As shown in FIG. 1, the present embodiment provides a method for detecting drowning, comprising steps of:

S1: collecting a plurality of detection signals;

S2: recording the plurality of detection signals and determining whether a drowning is happening or not by calculating and analyzing each of the detection signals; and S3: sending out a drowning signal K when it is determined from all of the detection signals that the drowning is happening.

In the present embodiment, an intelligent and quick detection for drowning situation is achieved, and an accuracy of drowning detection is improved, by means of detecting the plurality of detection signals sent by a plurality of sensors worn by a drowner.

Optionally, the step of determining whether a drowning is happening or not by calculating and analyzing each of the detection signals comprises: comparing a result obtained by calculating and analyzing a currently collected detection signal with a result obtained by calculating and analyzing a previously collected detection signal.

Optionally, the plurality of detection signals comprise a temperature signal, a pressure signal and an acceleration signal.

It should be understood that any other detection parameters may also be used to implement the detection, which are not limited herein.

Optionally, a step of processing the temperature signal comprises:

recording a temperature signal $T_i$ at time $t_i$;

comparing the temperature signal $T_i$ with a temperature signal $T_{i-1}$ at time $t_{i-1}$ and obtaining a temperature difference $\Delta T_i = |T_i - T_{i-1}|$;

determining that the drowning is happening and sending out a drowning signal K1 in a case of $\Delta T_i \geq \Delta T_0$, $\Delta T_{i+n} = 0$ and $t_{i+n} - t_i \geq t_T$, where $\Delta T_0$ is a preset temperature difference value, $t_T$ is a preset time value, and i and n are positive integers.

That is to say, when a difference $\Delta T_i$ between two adjacent detection values for temperature signal presents a sharp change (i.e., greater than the preset temperature difference value $\Delta T_0$), and subsequent detection values $\Delta T_{i+n}$ keep constant for several times (i.e., $\Delta T_{i+n} = 0$, the detection value is equal to water temperature due to being located in water at this time). If such a situation continues for a period of time $t_{i+n} - t_i$ (greater than the preset time value $t_T$), then it can be preliminary determined that the drowning is happening and a drowning signal K1 may be sent out.

It should be understood that $\Delta T_0$ may be set based on a weather condition in a region where a user exercises frequently. Generally, the greater $\Delta T_0$ is set to be, the higher an accuracy of detecting drowning is, for example, $\Delta T_0$ may be set to be 6° C. Similarly, the longer a duration time is, the higher an accuracy of detecting drowning is, for example, $t_T$ may be set to be 3 min.

Certainly, the above preset values should be set in consideration to detection sensitivity, so that they should not be set to be overlarge.

Optionally, a step of processing the pressure signal comprises:

recording a pressure signal $P_i$ at time $t_i$;

comparing the pressure signal $P_i$ with a pressure signal $P_{i-1}$ at time $t_{i-1}$ and obtaining a pressure difference $\Delta P_i = |P_i - P_{i-1}|$;

determining that the drowning is happening and sending out a drowning signal K2 in a case of $\Delta P_i > 0$, $P_{i+n} > 0$, $\Delta P_{i+n} = 0$ and $t_{i+n} - t_i \geq t_P$, where $t_P$ is a preset time value, and i and n are positive integers.

In a normal state, the pressure signal is $P_0$, while $P_i = \rho gh + P_0$ if the drowning is happening, where ρ is a density of water, g is a gravitational acceleration, and h is a depth of water.

A pressure sensor may be provided to detect a pressure of water, if $\Delta P_i = |P_i - P_{i-1}| > 0$, and $P_{i+n} > 0$ in several subsequent detections, then it indicates that the drowner is in the water, at the same time, if $\Delta P_{i+n} = 0$, i.e., the drowner is in a drowning state for a period of time $t_{i+n} - t_i$, then it can be preliminary determined that the drowning is happening and a drowning signal K2 may be sent out.

It should be understood that $t_P$ may be set based on a detailed application condition. Generally, the longer a duration time is, the higher an accuracy of detecting drowning is. Certainly, the preset value $t_P$ should be set in consideration to detection sensitivity, so that it should not be set to be overlarge, for example, $t_P$ may be set to be 2 min.

Optionally, a step of processing the acceleration signal comprises:

recording an acceleration signal;

calculating a frequency f at which motion directions change, and comparing the frequency f with a preset frequency value $f_0$, and determining that the drowning is happening and sending out a drowning signal K3 in a case of $f \geq f_0$.

When the drowning is happening, the arms and body of the drowner generally swing back-and-forth, and in this case, the swing frequency is significantly increased. The acceleration signals are recorded, the frequency f at which motion directions change is calculated from the acceleration signals, and the frequency f is compared with the preset frequency value $f_0$. If $f \geq f_0$, it may be determined that the drowning is happening and a drowning signal K3 may be sent out.

It should be understood that $f_0$ may be set based on a detailed application condition. Generally, the greater the preset value is, the higher an accuracy of detecting drowning is, and the frequency $f_0$ is typically set to be 10 times per second. Certainly, the preset value $f_0$ should be set in consideration to detection sensitivity, so that it should not be set to be overlarge.

It should be understood that detection periods for the above three detection signals may be set based on a detailed condition. When it is determined that the drowning is happening based on all the above three detection signals, a drowning signal K may be sent out. The drowning signal K may be uploaded to an internet via a signal sending unit 3, the internet system may quickly send out a distress signal to a related rescue authority based on a position information together with the drowning signal, meanwhile, send out a distress signal to wearers in a region adjacent to the drowning position, for example, in a region within 100 meters distance.

The signal sending unit 3 may comprise a wireless communication unit, a wireless internet module, a position positioning module, and the like, which belongs to the prior art and will not be further described herein.

Embodiment II

Figure 2:
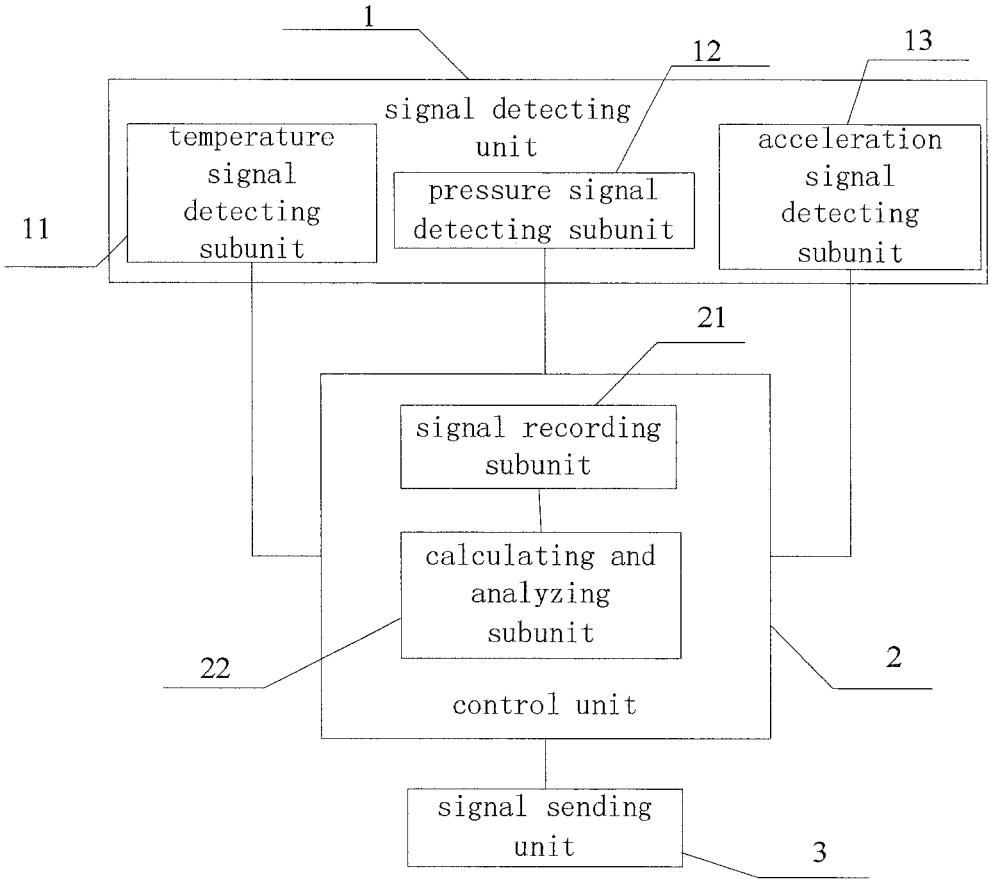
FIG. 2 is a schematic structural view of a device for detecting drowning according to an embodiment of the present disclosure.

As shown in FIG. 2, the present embodiment provides a device for detecting drowning, comprising:

a signal detecting unit 1 configured to collect a plurality of detection signals;

a control unit 2 configured to record the plurality of detection signals and determine whether a drowning is happening or not by calculating and analyzing the plurality of detection signals; and a signal sending unit 3 configured to send out a drowning signal.

In the present embodiment, an intelligent and quick detection for drowning situation is achieved, and an accuracy of drowning detection is improved, by means of detecting the plurality of detection signals sent by the device for detecting drowning with a plurality of sensors worn by a drowner.

Optionally, the signal detecting unit 1 comprises a temperature signal detecting subunit 11, a pressure signal detecting subunit 12 and an acceleration signal detecting subunit 13.

It should be understood that any other detecting units may also be used to implement the detection, which are not limited herein.

Optionally, the control unit 2 comprises: a signal recording subunit 21 configured to record the plurality of detection signals; and a calculating and analyzing subunit 22 configured to determine whether a drowning is happening or not by calculating and analyzing the plurality of detection signals.

Optionally, the signal recording subunit 21 is configured to record a temperature signal $T_i$ sent by the temperature signal detecting subunit 11 at time $t_i$;

the calculating and analyzing subunit 22 is configured to compare the temperature signal $T_i$ with a temperature signal $T_{i-1}$ at time $t_{i-1}$ and obtain a temperature difference $\Delta T_i = |T_i - T_{i-1}|$; and the calculating and analyzing subunit determines that the drowning is happening and the signal sending unit sends out a drowning signal K1 in a case of $\Delta T_i \geq \Delta T_0$, $\Delta T_{i+n} = 0$ and $t_{i+n} - t_i \geq t_T$, where $\Delta T_0$ is a preset temperature difference value, $t_T$ is a preset time value, and i and n are positive integers.

That is to say, when a difference $\Delta T_i$ between two adjacent detection values for temperature signal presents a sharp change (i.e., greater than the preset temperature difference value $\Delta T_0$), and subsequent detection values $\Delta T_{i+n}$ keep constant for several times (i.e., $\Delta T_{i+n} = 0$, the detection value is equal to water temperature due to being located in water at this time). If such a situation continues for a period of time $t_{i+n} - t_i$ (greater than the preset time value $t_T$), then it can be preliminary determined that the drowning is happening and a drowning signal K1 may be sent out.

It should be understood that $\Delta T_0$ may be set based on a weather condition in a region where a user exercises frequently. Generally, the greater $\Delta T_0$ is set to be, the higher an accuracy of detecting drowning is, for example, $\Delta T_0$ may be set to be 6° C. Similarly, the longer a duration time is, the higher an accuracy of detecting drowning is, for example, $t_T$ may be set to be 3 min.

Certainly, the above preset values should be set in consideration to detection sensitivity, so that they should not be set to be overlarge.

Optionally, the signal recording subunit 21 is further configured to record a pressure signal $P_i$ sent by the pressure signal detecting subunit 12 at time $t_i$;

the calculating and analyzing subunit 22 is further configured to compare the pressure signal $P_i$ with a pressure signal at time $t_{i-1}$ and obtain a pressure difference $\Delta P_i = |P_i - P_{i-1}|$; and the calculating and analyzing subunit determines that the drowning is happening and the signal sending unit sends out a drowning signal K2 in a case of $\Delta P_i > 0$, $P_{i+n} > 0$, $\Delta P_{i+n} = 0$ and $t_{i+n} - t_i \geq t_P$, where $t_P$ is a preset time value, and i and n are positive integers.

In a normal state, the pressure signal is $P_0$, while $P_i = \rho gh + P_0$ if the drowning is happening, where ρ is a density of water, g is a gravitational acceleration, and h is a depth of water.

A pressure sensor may be provided to detect a pressure of water, if $\Delta P_i = |P_i - P_{i-1}| > 0$, and $P_{i+n} > 0$ in several subsequent detections, then it indicates that the drowner is in the water, at the same time, if $\Delta P_{i+n} = 0$, i.e., the drowner is in a drowning state for a period of time $t_{i+n} - t_i$, then it can be preliminary determined that the drowning is happening and a drowning signal K2 may be sent out.

It should be understood that $t_P$ may be set based on a detailed application condition. Generally, the longer a duration time is, the higher an accuracy of detecting drowning is. Certainly, the preset value $t_P$ should be set in consideration to detection sensitivity, so that it should not be set to be overlarge, for example, $t_P$ may be set to be 2 min.

Optionally, the signal recording subunit 21 is further configured to record an acceleration signal sent by the acceleration signal detecting subunit 13;

the calculating and analyzing subunit 22 is further configured to calculate a frequency f at which motion directions change; and the calculating and analyzing subunit determines that the drowning is happening and the signal sending unit sends out a drowning signal K3 in a case of $f \geq f_0$, where $f_0$ is a preset frequency value.

When the drowning is happening, the arms and body of the drowner generally swing back-and-forth, and in this case, the swing frequency is significantly increased. The acceleration signals are recorded, the frequency f at which motion directions change is calculated from the acceleration signals, and the frequency f is compared with the preset frequency value $f_0$. If $f \geq f_0$, it may be determined that the drowning is happening and a drowning signal K3 may be sent out.

It should be understood that $f_0$ may be set based on a detailed application condition. Generally, the greater the preset value is, the higher an accuracy of detecting drowning is, and the frequency $f_0$ is typically set to be 10 times per second. Certainly, the preset value $f_0$ should be set in consideration to detection sensitivity, so that it should not be set to be overlarge.

It should be understood that the above temperature signal detecting subunit 11, pressure signal detecting subunit 12 and acceleration signal detecting subunit 13 may be chosen from commercially available corresponding types of sensor, which are not limited herein.

It should be understood that detection periods for the above three detection signals may be set based on a detailed condition. When it is determined that the drowning is happening based on all the above three detection signals, a drowning signal K may be sent out. The drowning signal K may be uploaded to an internet via a signal sending unit 3, the internet system may quickly send out a distress signal to a related rescue authority based on position information together with the drowning signal, meanwhile, send out a distress signal to wearers in a region adjacent to the drowning position, for example, in a region within 100 meters distance.

The signal sending unit 3 may comprise a wireless communication unit, a wireless internet module, a position positioning module, and the like, which belongs to the prior art and will not be further described herein.

It should be understood that the above embodiments are merely exemplary embodiments intended to explain principle of the present disclosure, however, the present disclosure is not limited hereto. Various changes and substitutions may be made to the present disclosure by the person skilled in the art without departing from the spirit and scope of the present disclosure, and these changes and substitutions fall into the scope of the present disclosure.

What is claimed is:

1. A method for detecting drowning of a user submerged in water, comprising steps of:

collecting, by a signal detecting unit, a plurality of detection signals comprising a temperature signal, a pressure signal and an acceleration signal; the signal detecting unit comprising a temperature signal detecting subunit, a pressure signal detecting subunit and an acceleration signal detecting subunit;

recording, by a control unit, the plurality of collected detection signals and determining, by the control unit, whether a drowning is happening or not by calculating and analyzing each of the collected detection signals; and wirelessly sending out to an internet, by a signal sending unit, a signal representing a drowning state K when it is determined, by the control unit, from all of the analyzed collected detection signals that the drowning is happening;

wherein the drowning state K comprises at least K1, K2, and K3 drowning states;

wherein a step of processing the temperature signal comprises:

recording, from the user, a temperature signal $T_i$ at time $t_i$;

comparing the temperature signal $T_i$ with a temperature signal $T_{i-1}$ at time $t_{i-1}$ and obtaining a temperature difference $\Delta T_i = |T_i - T_{i-1}|$;

determining that the drowning state K1 is happening and sending out a signal representing the drowning state K1 in a case of $\Delta T_i \geq \Delta T_0$, $\Delta T_{i+n} = 0$ and $t_{i+n} - t_i \geq t_T$, where $\Delta T_0$ is a preset temperature difference value, $t_T$ is a preset time value, and i and n are positive integers.

2. The method for detecting drowning of a user submerged in water according to claim 1, wherein the step of determining whether a drowning is happening or not by calculating and analyzing each of the collected detection signals by the control unit comprises: comparing a result obtained by calculating and analyzing a currently collected detection signal with a result obtained by calculating and analyzing a previously collected detection signal.

3. The method for detecting drowning of a user submerged in water according to claim 1, wherein a step of processing the pressure signal comprises:

recording, from the user, a pressure signal $P_i$ at time $t_i$;

comparing the pressure signal $P_i$ with a pressure signal $P_{i-1}$ at time $t_{i-1}$ and obtaining a pressure difference $\Delta P_i = |P_i - P_{i-1}|$;

determining that the drowning state K2 is happening and sending out a signal representing the drowning state K2 in a case of $\Delta P_i > 0$, $P_{i+n} > 0$, $\Delta P_{i+n} = 0$ and $t_{i+n} - t_i \geq t_P$, where $t_P$ is a preset time value, and i and n are positive integers.

4. The method for detecting drowning of a user submerged in water according to claim 1, wherein a step of processing the acceleration signal comprises:

recording an acceleration signal of the water;

calculating a frequency f at which motion of the water directions change, and comparing the frequency f with a preset frequency value $f_0$, and determining that the drowning state K3 is happening and sending out a signal representing the drowning state K3 in a case of $f \geq f_0$.

* * * * *